US011833660B1

(12) United States Patent
Ross

(10) Patent No.: US 11,833,660 B1
(45) Date of Patent: Dec. 5, 2023

(54) TOOL HOLDER

(71) Applicant: Eric J. Ross, Blackjack, MO (US)

(72) Inventor: Eric J. Ross, Blackjack, MO (US)

( * ) Notice: Subject to any disclaimer, the term of this patent is extended or adjusted under 35 U.S.C. 154(b) by 0 days.

(21) Appl. No.: 18/332,319

(22) Filed: Jun. 9, 2023

Related U.S. Application Data

(60) Provisional application No. 63/350,956, filed on Jun. 10, 2022.

(51) Int. Cl.
*B65D 85/28* (2006.01)
*B25H 3/06* (2006.01)

(52) U.S. Cl.
CPC ..... *B25H 3/06* (2013.01)

(58) Field of Classification Search
CPC ..... B25H 3/04; B25H 3/06
USPC ..... 206/234, 361, 362, 372, 373, 376, 379; 211/70.6, 71.01, 85.21, 85.25; 220/571, 220/697, 736
See application file for complete search history.

(56) References Cited

U.S. PATENT DOCUMENTS 4,765,472 A 8/1988 Dent
4,846,076 A * 7/1989 Menges, Sr. ..... A01K 97/22 297/188.09
4,867,332 A * 9/1989 Mains ..... B25H 3/04 206/372
5,211,294 A * 5/1993 Garman ..... B44D 3/123 248/213.2
5,261,577 A * 11/1993 Goldstein ..... B44D 3/12 220/736
D376,454 S 12/1996 Fierek et al.
D396,912 S 8/1998 Maire et al.
5,881,891 A 3/1999 Murphy, Jr.
6,446,829 B1 * 9/2002 Malvasio ..... B44D 3/123 220/736
6,823,998 B2 * 11/2004 Fabregas ..... B25H 3/06 211/70.6
7,337,901 B2 * 3/2008 Phillips ..... B25H 3/06 206/349
D677,895 S 3/2013 Camp, III
9,682,471 B2 * 6/2017 Jacobson ..... B25H 3/00
D820,542 S 6/2018 Rane et al.
10,906,697 B2 2/2021 Mittag
11,167,866 B2 11/2021 Bartlett et al.
2004/0055979 A1 * 3/2004 Fabregas ..... B25H 3/06 211/70.6
2006/0219586 A1 * 10/2006 Phillips ..... B44D 3/123 206/561
2014/0102925 A1 4/2014 Jacobson et al.
2016/0279786 A1 9/2016 Jacobson et al.
2017/0368675 A1 12/2017 Jacobson et al.

* cited by examiner

*Primary Examiner* — Luan K Bui
(74) *Attorney, Agent, or Firm* — Grace J. Fishel

(57) ABSTRACT

A tool holder having a bib shaped plate mounted on a U-shaped collar configured to nest inside a rim of a utility bucket. The plate has a cutout with a web that overhangs the inside of the bucket and a skirt around the periphery of the plate. The skirt terminates at ends of the cutout with insert tab extensions, each of which has a foot with an outwardly sloped arch, an inwardly projection heel and a horizontal toe. The web provides an edge to scrape off materials from a tool into the bucket while the heel secures the holder to the rim.

10 Claims, 5 Drawing Sheets

TOOL HOLDER

BACKGROUND OF THE INVENTION

Field of the Invention

The present invention relates to a tool holder with a flat plate supported on the rim of a utility bucket for holding tools while the product originally packaged in the bucket is used.

Brief Description of the Prior Art

Five gallon buckets are used on job sites to contain paint and mastics. They have been around for years and are commonly repurposed as tool caddies and for many other purposes such as seats, livestock feeders, "street" drums and the list goes on and on. But the existing tool caddies are not specially adapted to holding the tools that a worker needs while using the paint or mastic originally packaged in the bucket. In use, a worker either contaminates the work area with a wet brush or trowel or puts the brush or trowel back into the bucket where the handle may be gobbed with product. Either way, it is difficult for a user to keep the tool, the product and the work area clean.

BRIEF SUMMARY OF THE INVENTION

In an embodiment of the present invention a tool holder for attachment to a bucket having a rim has a bib shaped plate mounted on a U-shaped collar configured to nest inside the rim of the bucket. The plate has a semicircular cutout with first and second ends and an increased curvature along a portion of semicircular cutout forming a web configured to overhang the inside of the bucket. The web provides an edge against which a tool may be scraped dropping the scraped off material into the bucket. The plate also has a skirt around the periphery of the plate terminating at the first and second ends of the plate with an inset tab extension. The tab extension has a foot with an outwardly sloped arch which when cammed against the rim causes the heel to snap under the rim securing the plate to the bucket.

In some embodiments the underside of the plate is reinforced with a grid of transverse and longitudinal ribs. In other implementations, the U-shaped collar includes a first semicircular wall that nests inside the rim of the bucket and an second semicircular wall configured to engage the outside of the rim of the bucket. In one embodiment the transverse rib intersects the second semicircular wall. In another embodiment the transverse rib makes point contact with the rim and includes a perpendicular brace.

In other applications the plate has a recessed aperture configured for receipt of a flanged container. In still other cases additional apertures may be provided in the plate for receipt of a blade of screwdriver or a handle of a trowel together possibly with an elongated slot configured for receipt of a mud knife.

In view of the above, it is an object of the present invention to provide a tool holder for holding the tools usually needed in laying floors and painting walls with product in a five gallon bucket and for keeping the work area clean. Other objects and features of the invention will be in part apparent and in part pointed out hereinafter.

BRIEF DESCRIPTION OF THE SEVERAL VIEWS OF THE DRAWINGS

In the accompanying drawings, in which two of various possible embodiments of the invention is illustrated, corresponding reference characters refer to corresponding parts throughout the several views of the drawings in which.

DETAILED DESCRIPTION OF AT LEAST ONE PREFERRED EMBODIMENT OF THE INVENTION

Figure 1:
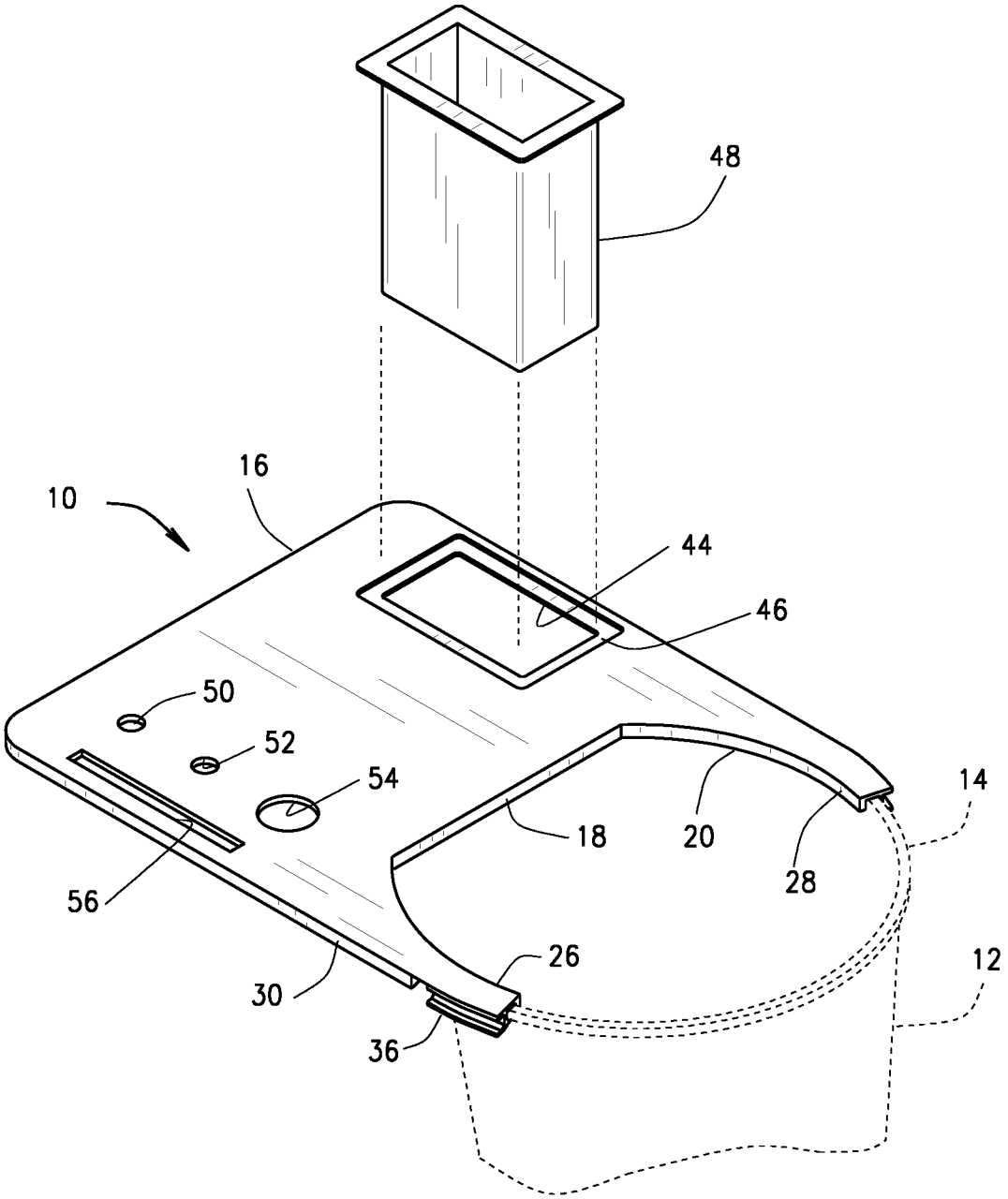
FIG. 1 is perspective view of a first tool holder in accordance with the present invention mounted on a prior art five gallon bucket.
Figure 2:
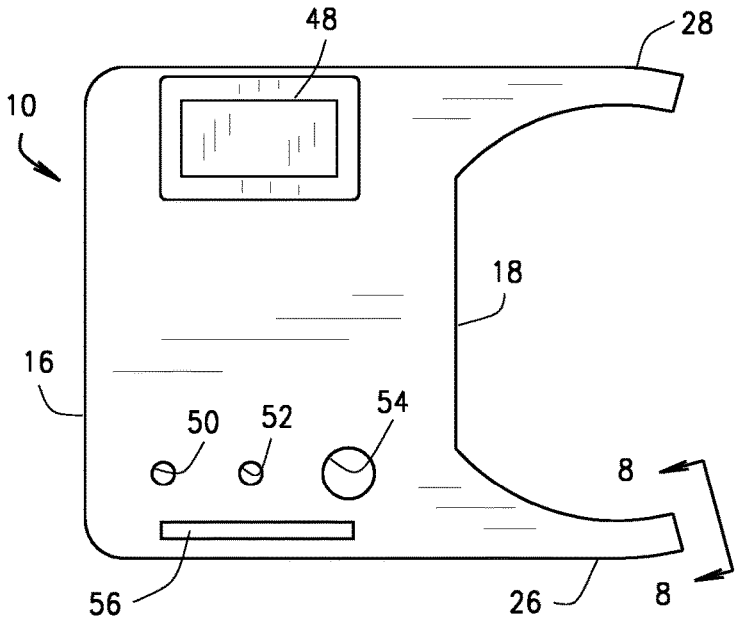
FIG. 2 is a top plan view thereof.
Figure 4:
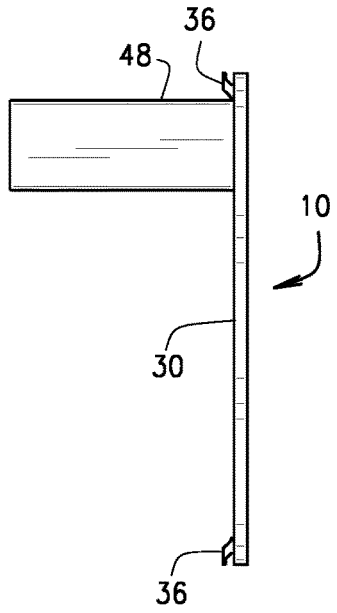
FIG. 4 is an end view from a cutout end of the plate as seen in FIG. 2.
Figure 15:
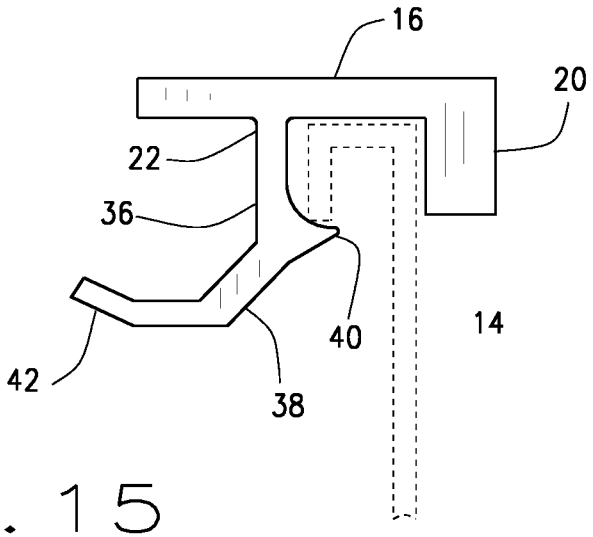
FIG. 15 is a detail taken along the line 15-15 in FIG. 9.

Referring to the drawings more particularly by reference character, a tool holder 10 is shown mounted on an ordinary five gallon utility bucket 12 in FIG. 1. Usually such buckets come with a bail handle and a lid not shown in the drawing and typically have a curled over rim 14 as seen in FIG. 8 and FIG. 15.

Tool holder 10 in major part includes a plate 16 mounted on a U-shaped collar 18. As seen in the embodiment shown in FIGS. 1-8, collar 18 includes an first semicircular wall 20 configured to nest inside rim 14 of bucket 12 and a second semicircular wall 22 configured to engage the outside of rim 14. Plate 16 is bib shaped with a semicircular cutout 24 and is mounted on semicircular walls 20, 22 such that plate 16 overlays rim 14 of bucket 12. Semicircular cutout 24 has first and second ends 26, 28, respectively, and increased curvature along a portion of the curve such that plate 16 forms a web 28 overhanging the inside of bucket 12. With continuing reference to FIGS. 1-8, the region of reduced curvature is shown as a chord joining two points along the curvature of the cutout.

Figure 3:
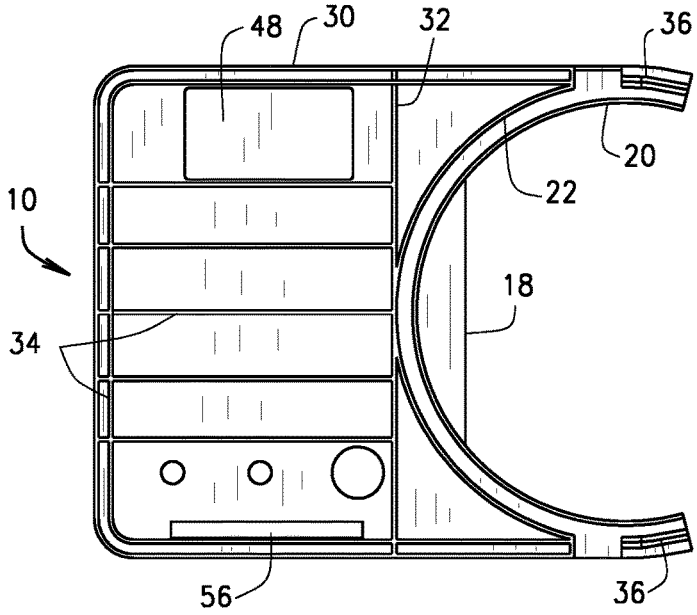
FIG. 3 is a bottom plan view thereof.
Figure 5:
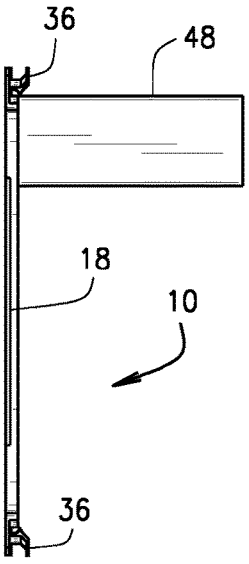
FIG. 5 is an end view from the cutout end of the plate as seen in FIG. 3.
Figure 6:
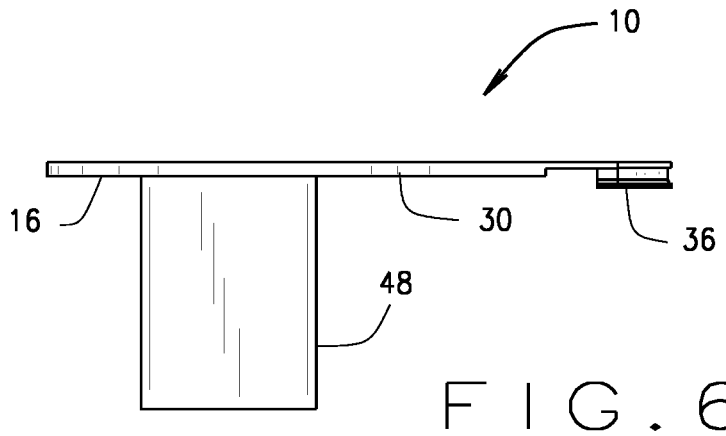
FIG. 6 is a left side view.
Figure 7:
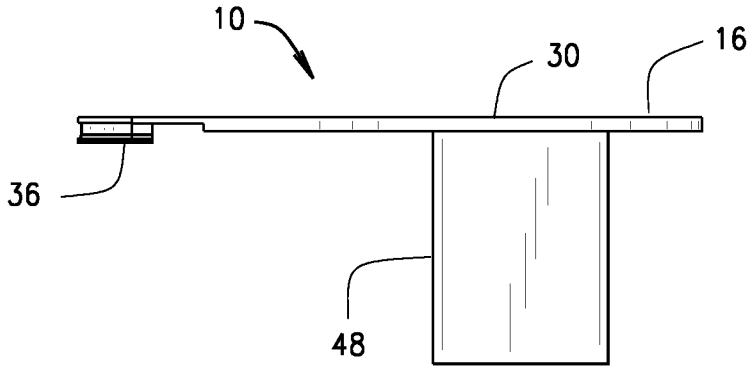
FIG. 7 is a right side view.

A skirt 30 depends around the periphery of plate 16 terminating at first and second ends 20, 22 of semicircular cutout 24. As seen in FIG. 3, an underside of plate 16 may be reinforced with a grid of ribs which as shown include a transverse rib 32 that intersects second semicircular wall 22 and a plurality of longitudinal ribs 34.

Figure 8:
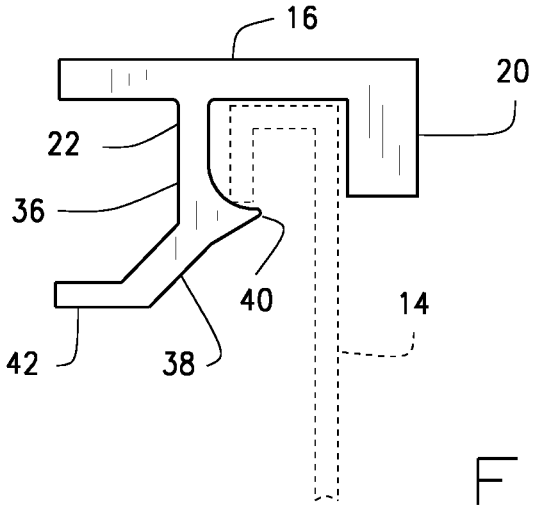
FIG. 8 is a detail taken along line 8-8 in FIG. 2.
Figure 9:
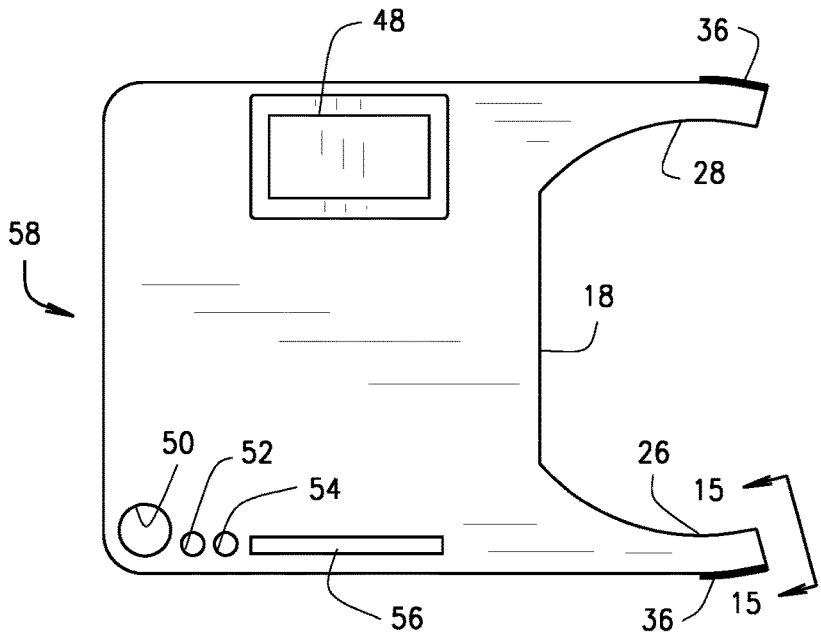
FIG. 9 is a top plan view of a second tool holder in accordance with the present invention.
Figure 11:
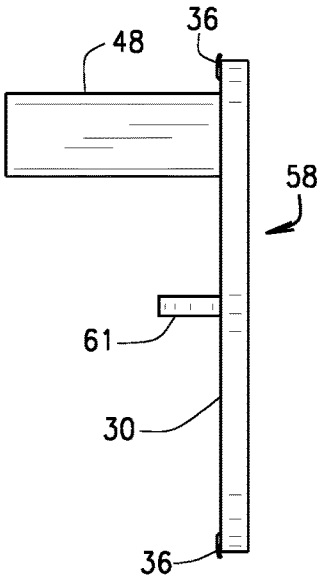
FIG. 11 is an end view from the cutout end of the plate as seen in FIG. 9.
Figure 10:
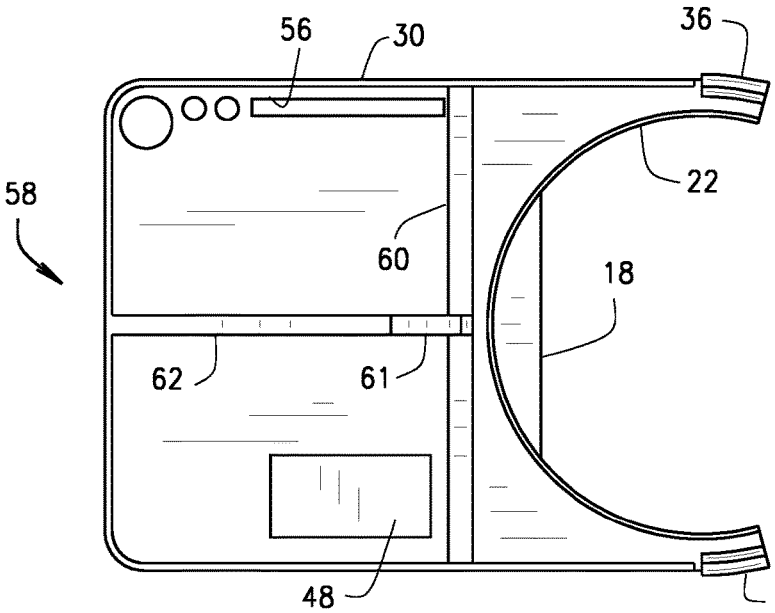
FIG. 10 is a bottom plan view thereof.
Figure 12:
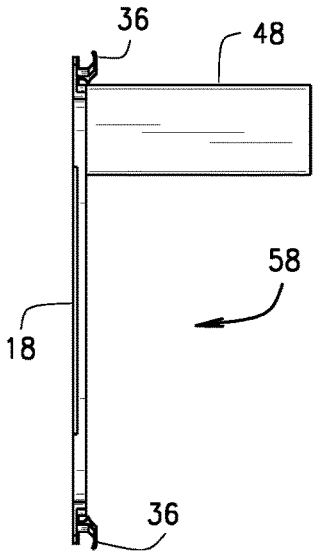
FIG. 12 is an end view from the cutout end of the plate as seen in FIG. 10.
Figure 13:
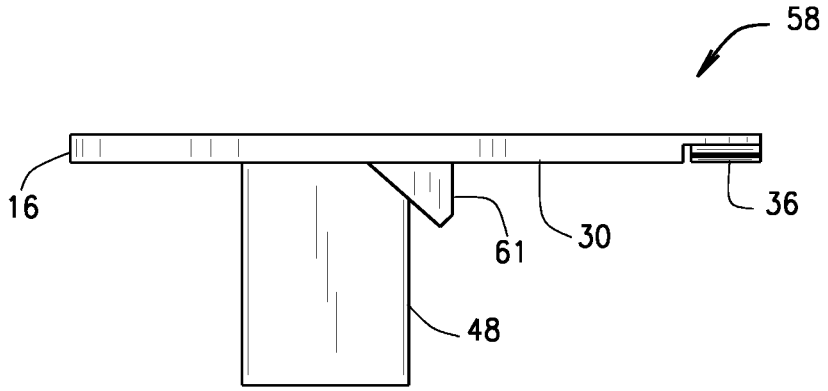
FIG. 13 is a left side view thereof.
Figure 14:
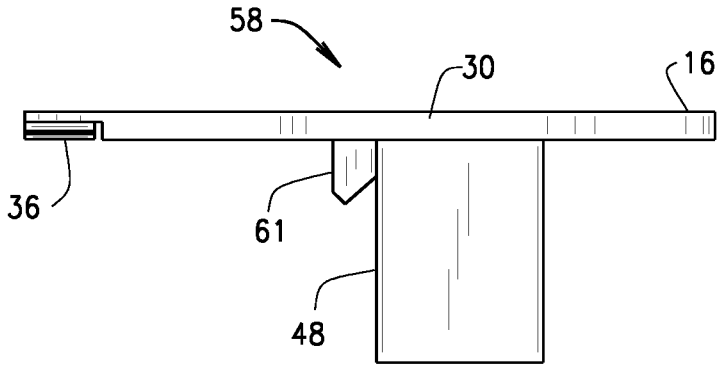
FIG. 14 is a right side view thereof.

In the embodiment shown in FIGS. 1-8, skirt 30 merges into second semicircular wall 22 at ends 26, 28 with an inset a tab extension 36. As shown in FIG. 8, tab extension 36 includes a foot with an outwardly sloped arch 38, an inwardly projecting heel 40 and a horizontal toe 42.

Plate 16 has an aperture 44 which is preferably recessed 46 into which a flanged container 48 may be seated. Other differently shaped apertures such as 50, 52 and 54 may be provided to receive the blades of screw drivers or the handles of other commonly used tools. An elongated slot 56 may also be provided for mud or drywall knives.

Turning now to FIGS. 11-15, a second tool holder 58 is shown similar to first embodiment 10 but differing in the replacement of second semicircular wall 22 with a transverse rib 60 having point contact with rim 14 and having a single longitudinal rib 62.

While plate 16 is illustrated as rectangular in configuration it will be understand that it may take other regular and irregular shapes. The essential features in holders 10, 58 being web 28 and heel 40 which work together as described below.

In use, bucket 12 with contents such as paint or mastic is taken to a job site. After the lid is removed from bucket 12, tool holder 10 (or 58) is seated on rim 14 as follows. As first semicircular wall 20 of collar 18 is slipped onto rim 14 of and holder 10 (58) is pushed down, rim 14 cams along arch 38 of tab extension 36 opening the tab extension such that heel 40 snaps into rim 14 as shown in FIGS. 8 and 15.

Small parts such spacers used in setting tile may be placed in container 48 within easy reach while other uses will occur to those working in the trades. Apertures 50, 52 and 54 and slot 56 may be used for holding tools while plate 16 provides a work surface and a convenient resting place for other tools. Web 28 provides an edge for cleaning product from a brush, trowel or like such that the extra material drops back into the bucket 12 and is not wasted or contaminates the working area. Heel 40 latched under rim 14 cooperatively resists upward displacement of plate 16 as a brush or trowel is scraped upward against the chord.

While holder 10 (58) has been described for use with an open bucket of paint or mastic, it will be understood that the holder may be used on an empty bucket 12 for other purposes as will occur to those skilled in the trades as well as for domestic and recreational purposes.

In view of the above, it will be seen that the object of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A tool holder for attachment to a bucket having a rim, said tool holder comprising a bib shaped plate mounted on a U-shaped collar configured to nest inside the rim of the bucket, said plate having a semicircular cutout with first and second ends and an increased curvature along a portion of semicircular cutout forming a web configured to overhang the inside of the bucket, said plate having a skirt around the periphery of the plate terminating at the first and second ends of the plate with an inset tab extension, said tab extension having a foot with an outwardly sloped arch, an inwardly projection heel and a horizontal toe, and said plate having an underside reinforced with a grid of transverse and longitudinal ribs.

2. The tool holder of claim 1 wherein the U-shaped collar includes a first semicircular wall that nests inside the rim of the bucket and an second semicircular wall configured to engage the outside of the rim of the bucket.

3. The tool holder of claim 2 wherein the transverse rib intersects the second semicircular wall.

4. The tool holder of claim 1 wherein the transverse rib makes point contact with the rim and includes a brace.

5. A tool holder for attachment to a bucket having a rim, said tool holder comprising a bib shaped plate mounted on a U-shaped collar configured to nest inside the rim of the bucket, said plate having a semicircular cutout with first and second ends and an increased curvature along a portion of semicircular cutout to form a web configured to overhang the inside of the bucket, said plate having a skirt around the periphery of the plate terminating at the first and second ends of the plate with an inset tab extension, said tab extension having a foot with an outwardly sloped arch, an inwardly projection heel and a horizontal toe, said plate having an underside reinforced with a grid of transverse and longitudinal ribs; and said plate having a recessed aperture configured for receipt of a flanged container.

6. The tool holder of claim 5 wherein said plate has at least one aperture configured for receipt of a blade of screwdriver or a handle of a trowel.

7. The tool holder of claim 5 wherein said plate has an elongated slot configured for receipt of a mud knife.

8. The tool holder of claim 5 wherein the U-shaped collar includes a first semicircular wall that nests inside the rim of the bucket and a second semicircular wall configured to engage the outside of the rim of the bucket.

9. The tool holder of claim 8 wherein the skirt merges into the second semicircular wall at the first and second ends.

10. The tool holder of claim 5 wherein the web is a chord joining two points along the curvature of the cutout.

* * * * *